US005836435A

United States Patent [19]

Fujita et al.

[11] Patent Number: 5,836,435

[45] Date of Patent: Nov. 17, 1998

[54] BILL HANDLING APPARATUS

[75] Inventors: Masanobu Fujita; Noriyuki Kanno, both of Kanagawa, Japan

[73] Assignee: Japan Cash Machine Co., Ltd., Japan

[21] Appl. No.: 732,212

[22] PCT Filed: Mar. 7, 1996

[86] PCT No.: PCT/JP96/00562

§ 371 Date: Mar. 31, 1997

§ 102(e) Date: Mar. 31, 1997

[87] PCT Pub. No.: WO96/27860

PCT Pub. Date: Sep. 12, 1996

[30] Foreign Application Priority Data

Mar. 7, 1995 [JP] Japan ..... 7-047651

[51] Int. Cl.[6] ..... G07F 7/04

[52] U.S. Cl. ..... 194/206

[58] Field of Search ..... 194/206, 207, 194/350; 271/177–181; 209/534

[56] References Cited

U.S. PATENT DOCUMENTS 4,809,967 3/1989 Kondo ..... 271/181
5,411,249 5/1995 Zouzoulas ..... 271/181

FOREIGN PATENT DOCUMENTS 57-44431 10/1982 Japan .
60-10370 1/1985 Japan .
63-211099 9/1988 Japan .

*Primary Examiner*—F. J. Bartuska
*Attorney, Agent, or Firm*—Bachman & LaPointe, P.C.

[57] ABSTRACT

A bill handling apparatus 1 is provided which comprises validator 2 provided with validating sensor 22 for validating a bill inserted into the apparatus 1; stacker 3 for storing a bill in response to an output from the validator 2 when the bill is considered genuine by the validator 2; a frame 4 for supporting the stacker 3; coupling device 10 for detachably supporting the validator 2 to align a passageway 21 of the validator 2 with a passageway 31 of the stacker means 3, the coupling device 10 being provided between the validator 2 and frame 4; and connector 60 for electrically connecting the validating sensor 22 in the validator 2 with validator control device 8 in the frame 4. When the validator 2 is connected to the stacker 3 by the coupling device 10 in the condition that the passageways of the validator 2 and stacker 3 are aligned with each other, the validating sensor 22 is automatically electrically connected with the validator control device 8 positioned in the frame 4 through the connector 60, and the conveyer 20 in the validator 2 is automatically drivingly connected with drive device 6 in the frame 4 through power transmitter.

6 Claims, 6 Drawing Sheets

BILL HANDLING APPARATUS

FIELD OF THE INVENTION

This invention relates to a bill handling apparatus such as a vending machine or an automatic exchanger, in particular, to the improvement in the bill handling apparatus wherein a bill validator is attached to a frame of the apparatus and easily removed therefrom for interchange.

BACKGROUND OF THE TECHNOLOGY

A prior art bill handling apparatus includes a bill validator for validating a bill and a stacker for storing bills considered valid by the bill validator. For example, Japanese Utility Model Disclosure No. 58-117568 published Aug. 11, 1983 discloses a bill validator with which a stacker is integrally incorporated to form a shorter passageway for bill in order to manufacture the apparatus in smaller size. Also, Japanese Patent Publication No. 3-10156 published Feb. 13, 1991 demonstrates a bill apparatus which comprises a casing; a validator disposed within the casing for validating a bill; a stacker for accumulating bills considered genuine by the validator; a L-shaped passageway formed through the validator and stacker; and a pusher for forcing a bill in the passageway into the stacker. In this prior art reference, the stacker is rotatably attached to the case to reduce the depth of the casing for the small sized apparatus.

Provided in prior art bill handling apparatus to validate a bill is a validator which is firmly and incommutably secured to a stacker so that the bill handling apparatus itself should be exchanged when a different kind of bills should be validated or when the validator has broken down.

Accordingly, an object of the present invention is to provide a bill handling apparatus which includes a validator easily and exchangeably attached thereto.

SUMMARY OF THE INVENTION

The bill handling apparatus according to the present invention comprises validator means which is provided with sensor means for validating a bill inserted into the apparatus; stacker means for storing a bill in response to an output from the validator means when the bill is considered genuine by the validator means; a frame for supporting the stacker means; coupling means for detachably supporting the validator means to align a passageway of the validator means with a passageway of the stacker means, the coupling means being provided between the validator means and frame; and connector means for electrically connecting the sensor means in the validator means with validator control means in the frame. The coupling means includes guide means provided in one of the frame and validator; pins provided in the other of the frame and validator in engaged relation to the guide means; a stopper lever rotatably provided in the frame; an abutment formed in the validator for engagement with the stopper lever; and a spring for resiliently urging the stopper lever toward the abutment to keep the engagement between the stopper lever and abutment. A slider is provided in the frame for releasing the validator from the frame by disengagement of said stopper lever from said validator. The coupling means includes guide means provided in the frame; and pins provided in the validator in engaged relation to the guide means. The bill handling apparatus may also comprises power transmission means for drivingly connecting the drive means in the frame with conveyer means in the validator. The power transmission means comprises a drive gear of the drive means rotatably supported on the frame; and a follower gear of the conveyer means rotatably mounted on the validator for engagement with the drive gear so that the drive and follower gears are in a same plane, when the validator is connected with the stacker by the coupling means in the condition that the passageways of the validator and stacker are aligned to each other. The connector means comprises a plug of the validator sensor in the validator means and a jack in the frame, the plug and jack are in a same plane so that the plug can be inserted into the jack.

When the validator means is connected to the stacker means by the coupling means in the condition that the passageways of the validator means and stacker means are aligned with each other, the sensor means is electrically connected with the validator control means positioned in the frame through the connector means, and the conveyer means in the validator means is drivingly connected with the drive means in the frame through the power transmission means.

The foregoing as well as other objects of the present invention will become apparent during the course of the following description with reference to the accompanying drawings.

BEST MODES FOR EMBODIMENT OF THE INVENTION

Referring now to the accompanying drawings, an embodiment according to the present invention will be described hereinafter in reference to FIGS. 1 to 8.

Figure 1:
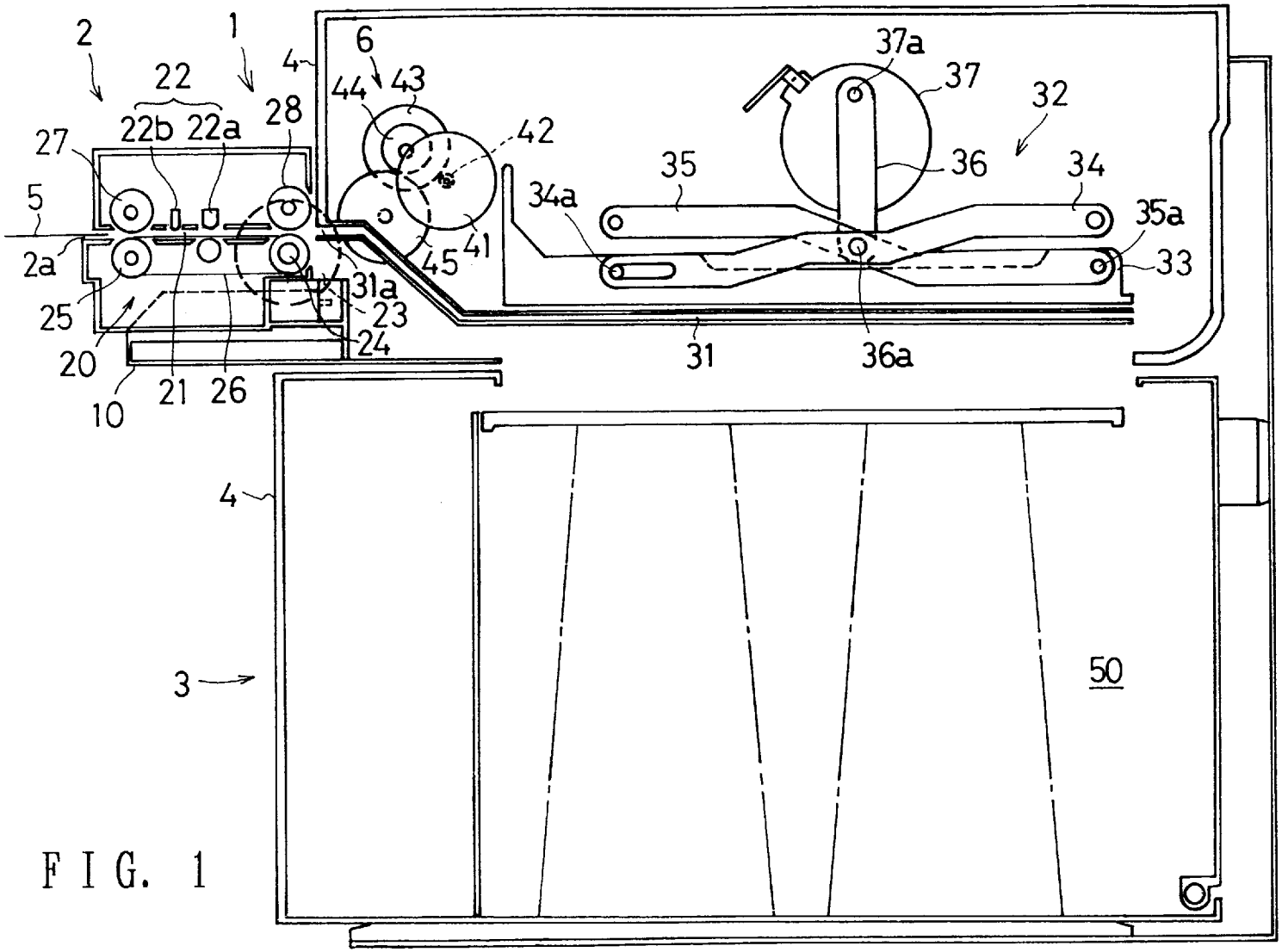
FIG. 1 is a sectional view of a bill handling apparatus according to the present invention.
Figure 2:
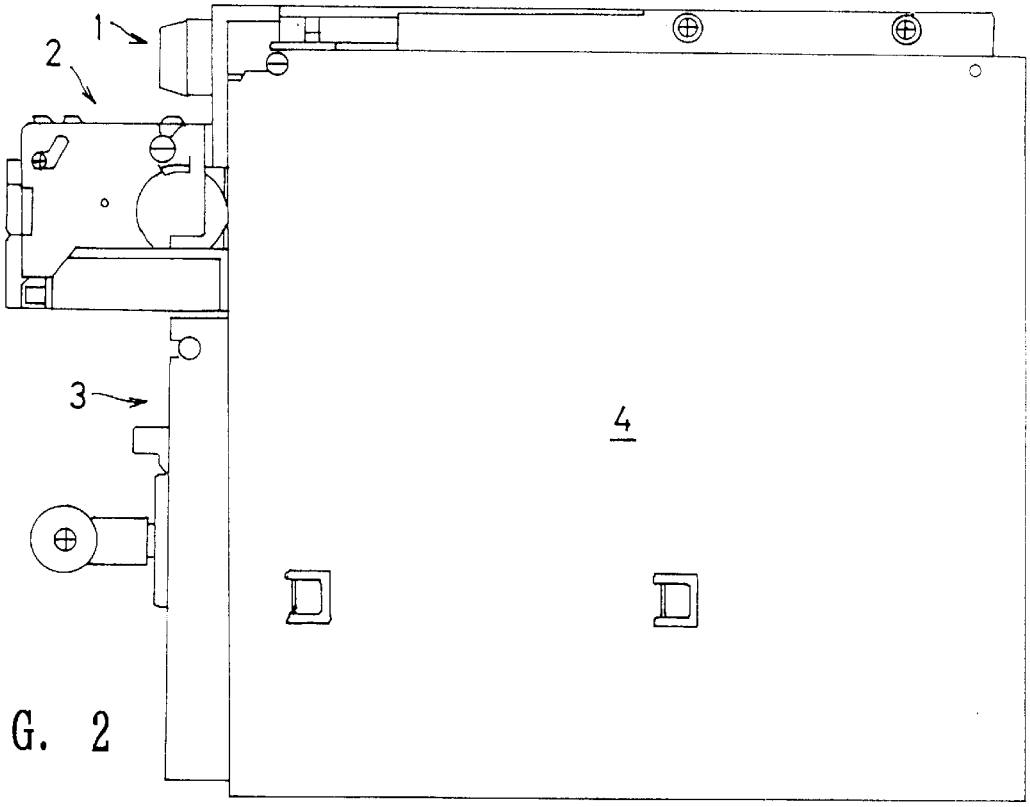
FIG. 2 is a side elevation view of the apparatus.
Figure 3:
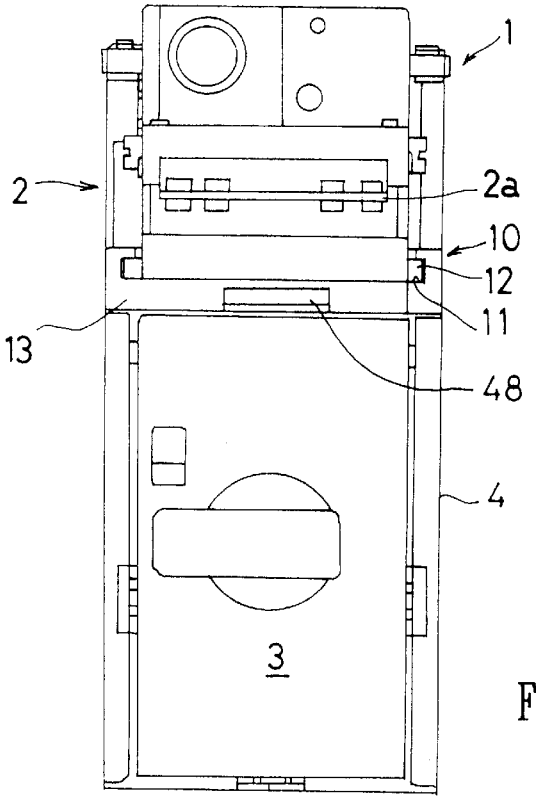
FIG. 3 is a front view of the apparatus.
Figure 4:
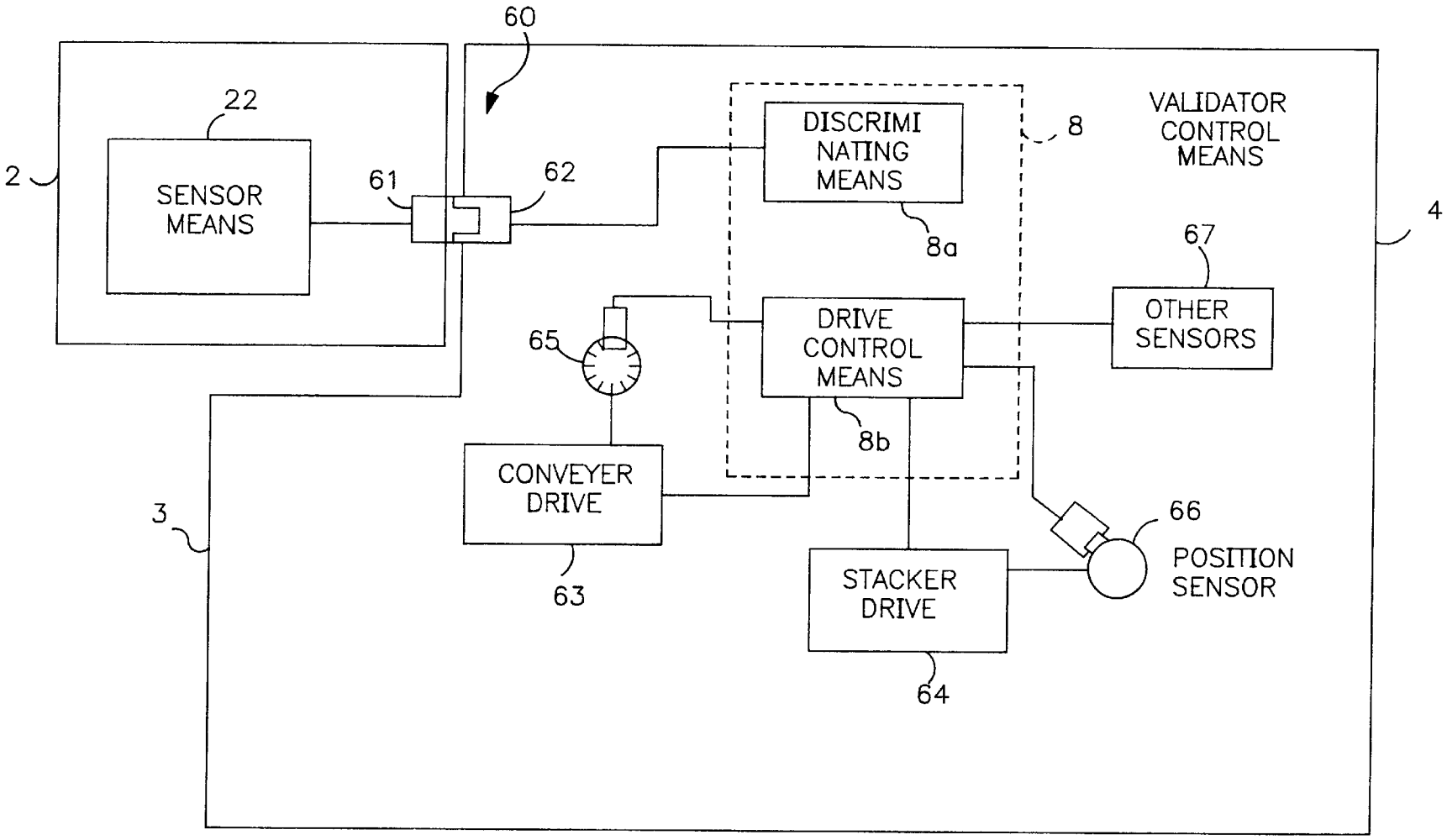
FIG. 4 is a block diagram of electric circuits used in the apparatus.
Figure 5:
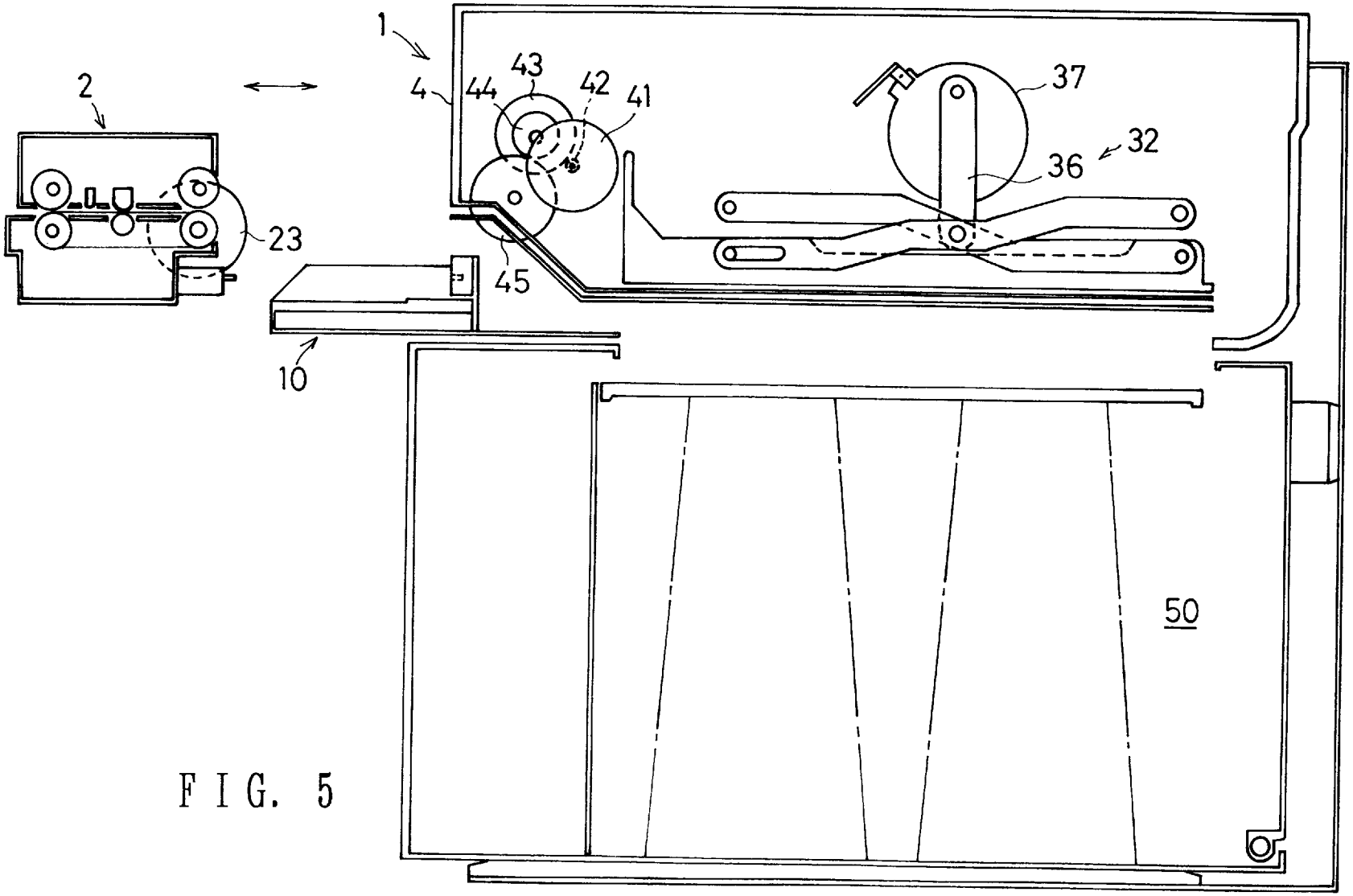
FIG. 5 is a sectional view of the apparatus from which validator means has been removed.
Figure 6:
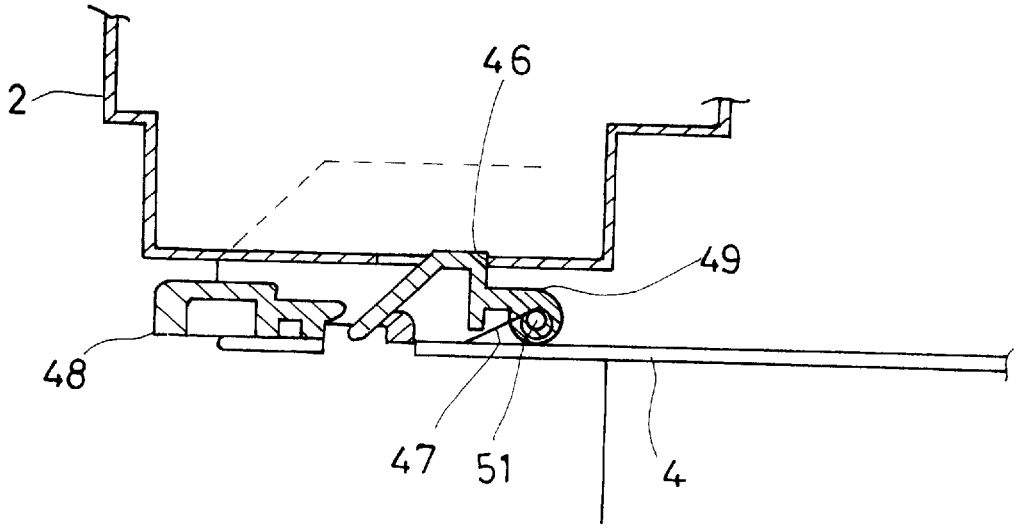
FIG. 6 is a partial section indicating a stopper lever of coupling means which is engaged with the validator means.

As shown in FIGS. 1 to 5, the bill handling apparatus 1 according to the present invention, comprises validator means 2 for validating a bill inserted into the apparatus 1; stacker means 3 for storing a bill in response to an output from the validator means 2 when the bill is considered genuine by the validator means 2; a frame 4 for supporting the stacker means 3; coupling means 10 for detachably supporting the validator means 2. The validator means 2 comprises a conveyer means 20) for providing the passageway 21 and sensor means 22 disposed adjacent to the passageway 21 and validator control means 8 positioned in the frame 4 as shown in FIG. 4. The conveyer means 20 comprises a follower gear 23; a pulley 24 drivingly connected with the follower gear 23; at least a belt 26 wound around the pulleys 24, 25; and rollers 27, 28 rotatably mounted on the validator means 2 opposite respectively to the pulleys 24, 25. The sensor means 22 includes a magnetic sensor 22*a* to detect magnetic features from ferrous ink on a bill, and an optical sensor 22*b* to detect optical features of a bill from a light beam reflected on a surface of the bill or permeated through the bill. Disposed adjacent to an inlet 2*a* of the validator means 2 is an optical sensor not shown which detects insertion of a bill 5 into the inlet 2 to produce a trigger signal for activation of the conveyer means 20.

Figure 7:
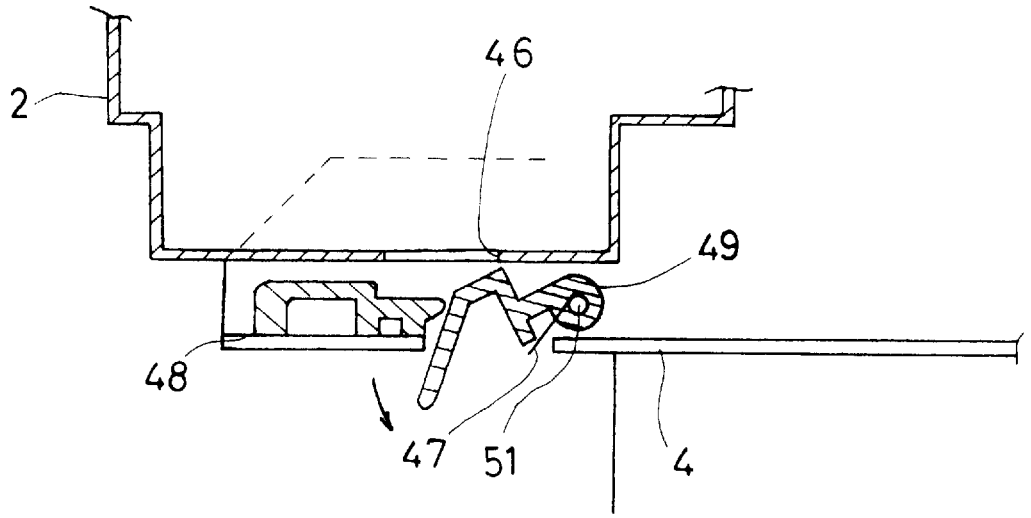
FIG. 7 is a partial section of the stopper lever disengaged from the validator means.
Figure 8:
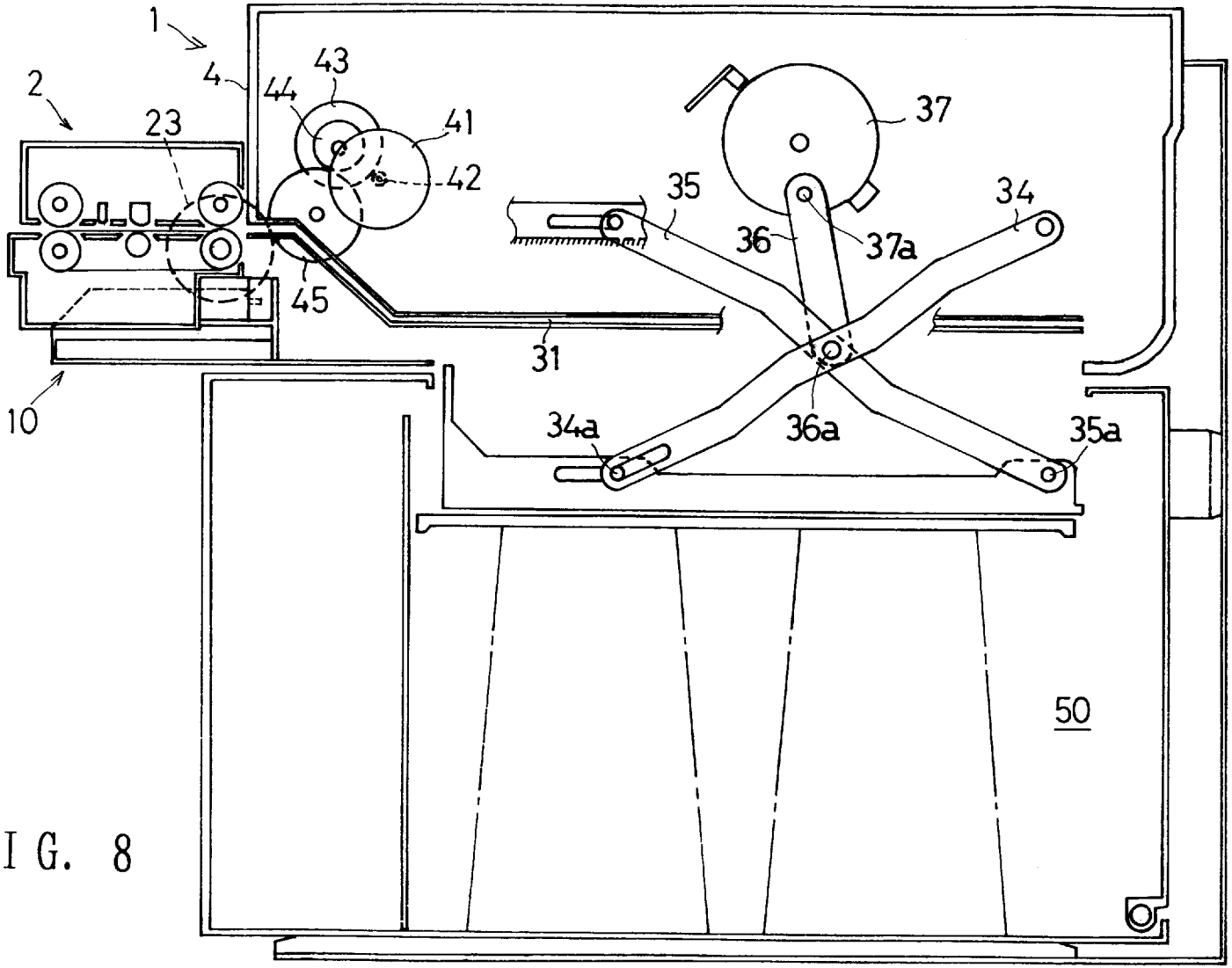
FIG. 8 is a sectional view of the apparatus with stacker means into which a bill is forced.

As shown in FIG. 3, the coupling means 10 is provided between the validator means 2 and frame 4 to removably support the validator means 2 on the frame 4 so that the passageway 21 of the validator means 2 is kept in aligned condition with an inlet 31*a* of the passageway 31 of the stacker means 31. The coupling means 10 includes guide means 13 provided in the frame 4 and a pair of pins 12 provided in the validator means 2 in engaged relation to a pair of guide grooves 11 formed on opposite sides of the guide means 13. As illustrated in FIG. 7, the coupling means 10 comprises a stopper lever 49 rotatably provided in the frame 4 by a shaft 51; an abutment 46 formed in the validator means 2 for engagement with the stopper lever 49; and a spring 47 for resiliently urging the stopper lever 49 toward the abutment 46 to keep the engagement between the stopper lever 49 and abutment 46. A slider 48 is slidably provided in the frame 4 to release the engagement of the stopper lever 49 with of the abutment 46 of the validator means 2.

The stacker means 3 is operated to store a bill 5 in response to an output of the validator means 2 which has decided that the bill 5 is genuine. The stacker means 3 comprises a pusher 32 which forcibly pushes into a storage chamber 50 the bill 5 which is conveyed along the passageway 31. The pusher 32 has a push plate 33 in contact with the bill 5; two pairs of support links 34, 35 rotatably connected with the push plate 33 by pins 34*a*, 35*a*; and a press link 36 one end of which is rotatably connected by a pin 36*a* with approximately central portions of the support links 34, 35. The other end of the press link 36 is rotatably connected with a disk link 37 by a pin 37*a* so that the press link 36 can reciprocally move in the direction perpendicular to the passageway 31 during rotation of the disk link 37.

An electric motor 41 is arranged in the frame 4 to operate drive means 6 which drives the conveyer means (not shown) in the stacker means 3 to travel the bill 5 along the passageway 31 in the frame 4, but detailed drawing is omitted. The drive means 6 comprises a pinion 42 mounted on an output shaft of the motor 41, a first gear 43 meshed with the pinion 42, a second gear 44 secured to the first gear 43, and a drive gear 45 in engaged relation to the second gear 44 and a follower gear 23. The drive gear 45 and follower gear 23 provides a power transmission means which drivingly connects the drive means 6 in the frame 4 with the conveyer means 20 in the validator means 2. The drive gear 45 is rotatably supported on the frame 4, and the follower gear 23 is rotatably mounted on the validation means 2.

As shown in FIG. 4, provided between the validator means 2 and frame 4 is connector means 60 which comprises a plug 61 provided in the validator means 22 and a jack 62 in the frame 4 so that the plug 61 can be inserted into the jack 62 to electrically connect the sensor means 22 in the validator means 2 with validator control means 8 in the frame 4. When the validator means 2 is connected with the stacker means 3 by the coupling means 10, the passageways 21, 31 of the validator means 2 and stacker means 3 are retained in the aligned condition to each other. Simultaneously, the drive gear 45 of the drive means 6 in the frame 4 and the follower gear 23 of the conveyer means 20 in the validator means 2 are aligned to each other in a same plane. Also, the plug 61 of the validator means 2 and the jack 62 in the frame 4, are positioned in a same plane.

As understood from FIG. 4, the validator control means 8 comprises discriminating means 8*a* connected with the jack 62, and drive control means 8*b* connected with the discriminating means 8*a* to receive control signals from the discriminating means 8*a*. Also, the drive control means 8*b* is connected with a conveyer drive circuit 63 and a stacker drive circuit 64 to supply drive signals. In addition, the drive control means 8*b* is connected with an encoder 65 for recognition of moved position of the bill 5, a home position sensor 66 for detecting a retracted position of the push plate 33 and other sensors 67 so that the drive control means 8*b* may receive signals from the encoder 65 and sensors 66, 67.

When the validator means 2 is connected with the stacker means 3 by the coupling means 10 in the condition that the passageways 21, 31 of the validator means 2 and stacker means 3 are in the aligned condition to each other, the sensor means 22 of the validator sensor 22 in the validator means 2 can automatically and electrically be connected with the validator control means 8 through the connector means 60, and the conveyer means 20 in the validator means 2 can automatically be connected with the drive means 6 in the frame 4 through the drive gear 45 of the drive means 6 in the frame 4 and the follower gear 23 of the conveyer means 20 to transmit driving power from the drive means 6 to the conveyer means 20.

To exchange the validator means 20 with another one, the slider 48 is manually pushed toward the stopper lever 49 so that the stopper lever 49 is rotated around the shaft 51 against the resilient force of the spring 47 to release the engagement of the stopper lever 49 from the abutment 46 of the validator means 2. At this time, when the validator means 2 is pulled before, the pins 12 moves along the guide grooves 11 of the coupling means 10 to finally remove the validator means 2 outward from the frame 4 for exchange. When another validator means 2 is attached instead to the frame 4, the pins 12 are received within the guide grooves 11 and the validator means 2 is traveled inward and along the guide grooves 11 while the slider 48 is manually pushed. When the validator means 2 is pushed along the guide grooves 11 to enough depth, manual force is removed from the slider 48.

When a bill 5 is inserted into the inlet 2 of the validator means 2, the insertion of the bill 5 is detected by operation of the above-mentioned optical sensor which then produces an output. The validator control means 8 receives the output from the optical sensor and activates the motor 41 to drive the drive means 6. Consequently, the pinion 42, the first and second gears 43, 44, the drive gear 45 and follower gear 23 are rotated in turn to drive the conveyer means 20 so that the bill 5 is carried into the validator means 2. The validator control means 8 receives detection signals from the validator sensors 22, and decides whether the bill 5 is genuine or not. When the validator control means 8 has decided that the bill 5 is not genuine, it drives the motor 41 in the reverse direction to return the bill 5 to the inlet 2*a*. When the validator control means 8 has decided that the bill 5 is genuine, it continues to produce the drive signal to the motor 41 in the forward direction so that the conveyer means 20 is activated to travel of the bill 5 through the passageways 21 and 31 beneath the push plate 33 of the pusher 32. At this stage, the disk link 37 is rotated and the press link 36 is forcibly moved downward so that the support links 34, 35 are rotated from the retracted position of FIG. 1 to the extended position of FIG. 8 to store bills in the storage chamber 50 in the accumulated condition.

This embodiment of the instant invention produces the following effects:

(1) The validator means 2 can easily be exchanged.

(2) The validator means 2 without motor can be manufactured in light weight and small size for easy handling and maintenance.

(3) Other kinds of bills can be validated by exchange of the validator means 2 with another one. ROM (Read Only Memory) can be exchanged to alter the data processing for the discrimination of the bill (4) The single motor 41 is available to drive conveyer means 20 of the validator means 2 and stacker means 3 to manufacture the bill handling apparatus 1 in small size and at reduced cost.

Modes of the present invention may be varied in view of actual demands without limitation to the foregoing embodiment. For example, the conveyer means 20 and the disk link 37 can be driven by the single motor 41 in the different rotational direction. The pins 12 can be provided in the frame 4, while the guide means 13 can be provided in the validator means 2 to receive the pins 12. Another motor than the motor 41 may be provided in the validator means 2 to drive the conveyer means 20 by electric power supplied through the connector means 60 from power source. A part of the validator control means 8 may be disposed in the validator means 2 not in the frame 4.

As mentioned hereinbefore, the present invention realizes that validator means can easily be removed from the bill handling apparatus to replace with another one for easy maintenance and inspection of the validator means. In addition, the bill handling apparatus can readily respond to validate other kinds of bills or change of model or to accommodate to the modified specification of design.

What is claimed are:

1. In a bill handling apparatus including validator means for validating a bill inserted into said apparatus; stacker means for storing a bill in response to an output from said validator means when the bill is considered genuine by said validator means; and a frame for supporting said stacker means, said validator means including conveyor means for transporting the bill along a passageway, and sensor means disposed adjacent to said passageway, the improvement comprising:

coupling means provided between said validator means and frame for detachably supporting said validator means on said frame in the condition of alignment of said passageway of said validator means with a passageway of said stacker means;

connector means which comprises a plug and a jack, one of which is attached to a rear end of said validator means for electrical connection with said validator sensor, and the other is attached to a front end of said frame; and power transmission means which comprises a drive gear rotatably supported on said frame, and a follower gear rotatably mounted on said validator means and disposed on the same plane of said drive gear;

attachment of said validator means to said frame through said connector means, causes said follower gear of said validator means to automatically come into engagement with said drive gear of said frame, and simultaneously to automatically engage said plug and jack of said connector means with each other, whereby said conveyer means in said validator means can be driven by a motor provided outside said validator means and in said frame, and also sensor means in said validator means can forward its output to a validator control means provided outside said validator means and in said frame through said connector means.

2. A bill handling apparatus as defined in claim 1, wherein said coupling means including guide means provided in one of said frame and validator means, and pins provided in the other of said frame and validator means in engaged relation to said guide means.

3. A bill handling apparatus as defined in claim 1, wherein said coupling means includes guide means provided in said frame with a pair of guide grooves, and pins provided in said validator means for engagement with said guide grooves.

4. A bill handling apparatus as defined in claim 1, wherein said coupling means includes a stopper lever rotatably provided in said frame; an abutment formed in said validator means for engagement with said stopper lever; and a spring for resiliently urging said stopper lever toward said abutment to keep the engagement between said stopper lever and abutment.

5. A bill handling apparatus as defined in claim 3, wherein a slider is provided in said frame for releasing the validator means from the frame by disengagement of said stopper lever from said validator means.

6. A bill handling apparatus as defined in claim 1, wherein one of plug and jack in said validator means and the other of them in said frame are disposed on the same plane.

* * * * *